US006155095A

United States Patent [19]

Beetz

[11] Patent Number: 6,155,095

[45] Date of Patent: Dec. 5, 2000

[54] PLIERS INCLUDING A PLIERS HEAD AND A POSITIONING DEVICE

[75] Inventor: Horst Beetz, Stadtallendorf, Germany

[73] Assignee: Wezag GmbH Werkzeugfabrik, Germany

[21] Appl. No.: 09/342,586

[22] Filed: Jun. 29, 1999

[51] Int. Cl.[7] ..... H01R 43/042

[52] U.S. Cl. ..... 72/409.14; 72/461; 29/751

[58] Field of Search ..... 72/461, 409.13, 72/409.14, 420; 29/751

[56] References Cited

U.S. PATENT DOCUMENTS

| | | | |
|---|---|---|---|
| 3,393,438 | 7/1968 | Marley | 29/751 |
| 3,406,558 | 10/1968 | Tillmann | 29/751 |
| 4,637,242 | 1/1987 | Undin | 72/461 |
| 4,736,614 | 4/1988 | Fryberger | 72/461 |

FOREIGN PATENT DOCUMENTS 725 284 9/1942 Germany .

27 18 165 A1 10/1978 Germany .

OTHER PUBLICATIONS

Stand der Technik 1. Same as De 27 18 165 A1.

Stand der Technik 2. Aug. 28, 1996 Type CS 20 KS.

*Primary Examiner*—Daniel C. Crane
*Attorney, Agent, or Firm*—Klauber & Jackson

[57] ABSTRACT

Pliers (1) include a pliers head (2) defining a pliers head plane (5) and including a tool, the tool including a stationary first tool element (6) and a movable second tool element (7). A drive (15) moves the second tool element (7) with respect to the first tool element (6). A pivot bearing (10) has a pivot axis (11), the pivot axis (11) being arranged in a plane (12) parallel to the pliers head plane (5). A positioning device (9) includes at least one receiving element (20) for receiving a work piece (8). The positioning device (9) is pivotable with respect to the tool about the pivot axis (11) of the pivot bearing (10) to be moved from an insertion position for the work piece (8) to a working position for the work piece (8).

26 Claims, 8 Drawing Sheets

- 5 -
- 12 -

PLIERS INCLUDING A PLIERS HEAD AND A POSITIONING DEVICE

CROSS REFERENCE TO RELATED APPLICATIONS

This application claims the benefit of co-pending German Patent Application Number 198 32 884.2-15 entitled "Preβzange mit einem Zangenkopf und einem Positionierer", filed on Jul. 22, 1998.

FIELD OF THE INVENTION

The present invention generally relates to pliers for processing workpieces. The pliers include a pliers head and a positioning device. More particularly, the present invention relates to pliers including a positioning device serving to receive and to position a workpiece with respect to a two part tool being arranged in the pliers head.

BACKGROUND OF THE INVENTION

Pliers are to be understood as such pliers being used to process a workpiece. The pliers include a pliers head including tools enabling the processing of the workpiece due to an application of pressure or of a movement. The pliers may be pliers for crimping workpieces to connect a connector to a partially bare end of a conductor. It is also possible that the pliers are working pliers with which a workpiece is permanently deformed, or a portion is separated from the workpiece, for example by punching. The invention relates to a positioning device especially serving to receive and to position the workpiece with respect to the two part tool being arranged in the pliers head. The invention especially relates to positioning relatively small workpieces for which a manual positioning movement through the opening of the pliers head with respect to the movable tool element is difficult or even impossible. Especially in case of crimping connections, the connector and the bare end of the conductor each have to be brought to a certain relative position with respect to the tool elements. In this case, the tool elements are designed as crimping dies. Usually, one portion of the die is stationary with respect to the pliers head, whereas the other tool element is movably guided in a linear direction, on a circuit or in a different way.

Pliers are known from German Patent Application No. DE 27 18 165 A1. The pliers include a pliers head having a C-shaped design, i.e. the pliers head is laterally opened. In a different embodiment, the tool elements are moved with respect to one another in a scissors-like movement. In both cases, a pliers head plane is defined by the pliers head, the pliers head plane being the middle plane of the direction of main extension of the pliers head. The pliers include a positioning device being pivotable about a pivot axis or a pivot bearing being arranged at the pliers head. The positioning device can be pivoted from an insertion position to a working position. The positioning device includes at least one receiving element to receive a workpiece. The pivot bearing of the positioning device is arranged with its pivot axis to extend perpendicularly to the pliers head plane. In this way, it is possible to pivot the positioning device in the insertion position, to insert the workpiece into the receiving element and to pivot the positioning device with the inserted workpiece through the opened side of the pliers head in the working position in which the workpiece has the desired relative position with respect to the tool. The processing of the workpiece may be effected by actuating the drive of the pliers. The drive is designed as two handles being pivotable with respect to one another. Thus, the movement is transmitted to one tool element travelling through a working stroke with respect to the other tool element. In this way, for example, a connector can be deformed.

It is disadvantageous that a connector can be only inserted into the pliers head in case the pliers head is open at one side. In case of annularly closed pliers heads, this positioning device is not applicable. Due to the pivot movement of the positioning device on a circuit, the number and the arrangement of the nests inside the tool is limited due to the pivot radius to be kept free. The pliers including the known positioning device only include one receiving element being arranged at the positioning device, and consequently, only one nest being arranged at the tool. Although it is possible to mount the workpiece onto the positioning device in the insertion position, the clearance being provided for the mounting movement is limited. Since especially a very small workpiece has to be inserted into the correct receiving element, or it has to be put onto a projection by handling the workpiece manually, the handling gets more difficult due to the limited clearance between the pliers head.

Similar pliers are also known in the art. The pliers include a pliers head having a plate design, the pliers head having a C-shaped design, i.e. the pliers head is laterally open. The pliers head defines a pliers head plane being the middle plane of the direction of main extension of the pliers head. These known pliers include a positioning device being pivotable about a pivot axis of a pivot bearing being arranged at the pliers head to be pivoted from an insertion position to a working position of the workpiece. The positioning device at least includes one receiving element for receiving a workpiece. Usually, the positioning device includes two receiving elements being arranged at the positioning device and two processing locations being arranged in the pliers head, i.e. a two part tool having two processing nests which are, for example, allocated to different diameters of workpieces. The pivot bearing of the positioning device with its pivot axis is arranged to be located perpendicularly to the pliers head plane. In this way, it is possible to pivot the positioning device towards the insertion position, to insert the workpiece in the correct receiving element and to pivot the positioning device with the inserted workpiece through the open side of the C-shaped pliers head into the processing position in which the workpiece has the desired relative position with respect to the tool. The workpiece can be processed by actuating the drive of the pliers. The drive may be designed as two handles being pivotable with respect to one another, as hydraulically or pneumatically biased piston, or the like. In this way, the movement is transmitted to one of the tool elements travelling through a working stroke with respect to the other tool element. For example, a connector can be permanently deformed. Before the actual working process is effected, it is possible and it makes sense, in connection with the connector, to position the partially bare conductor with respect to the pliers head perpendicularly to the pliers head plane from the other side of the pliers head at which the positioning device is not located. Thus, the conductor gets into its desired relative position with respect to the tool, and the connector and the conductor can be connected in the working process. After the working process, the pliers are opened, and the workpiece, for example the conductor with the connector crimped thereto, is unloaded. To start a new working operation, the positioning device is pivoted in the insertion position, and the operation is repeated.

It is disadvantageous that a connector can be only inserted into the pliers head in case the pliers head is open at one side. In case of annularly closed pliers heads, this positioning device is not applicable. Due to the pivot movement of the positioning device on a circuit, the number and the arrangement of the nests inside the tool is limited due to the pivot radius to be kept free. The pliers including the known positioning device only includes one receiving element being arranged in the positioning device, and consequently, only one nest being arranged at the tool. Although it is possible to mount the workpiece onto the positioning device in the insertion position, the clearance being provided for the mounting movement is limited. Since especially a very small workpiece has to be inserted into the correct receiving element, or it has to be put onto a projection by handling the workpiece manually, the handling gets more difficult due to the limited clearance between the pliers head.

Other pliers of the applicant of the type CS20KS are known. The pliers include a C-shaped pliers head being open at one side. At the pliers head, a positioning device is linearly guided on an axle being connected to the pliers head. The axle is arranged in a plane parallel to the pliers head plane. The positioning device is driven by a pivotable handle being arranged at the pliers head. Thus, the positioning device can be linearly moved in the insertion position in which the positioning device is located in front of the opening of the C-shaped pliers head. The linear movement of the positioning device is directed in the direction of the arrangement of the two part tool in the pliers head, and it ends in the processing position in which an inserted workpiece takes its correct relative position with respect to the tool inside the pliers head. This known positioning device is only applicable in combination with a C-shaped, laterally open pliers head, but not in case of annularly closed pliers heads. Due to the linear guidance of the positioning device, a greater freedom results in the arrangement of the nests at the tool in the pliers head. The number and the arrangement of the nest is also comparatively less limited. The clearance around the positioning device in the insertion position is comparatively improved. Generally, these pliers having the linearly guided positioning device have the same disadvantages as the pliers in which the positioning device is pivotable about a pivot axis being located perpendicular to the pliers head plane.

Flat pliers to produce end portions at metallic tissue hoses are known from German Patent No. 725 284. The pliers include clamping jaws being guided parallel. The clamping jaws are separated to insert and to unload the workpiece and the portions of the workpiece, respectively. The first portions of the clamping jaws are each pivotable with respect to the pliers head plane by a pivot bearing. The pivot axis of the pivot bearing is arranged in a plane parallel to the pliers head plane. The flat pliers do not include a positioning device.

SUMMARY OF THE INVENTION

Briefly described, the present invention provides pliers including a pivotable positioning device for workpieces. The pliers include a pliers head defining a pliers head plane and including a tool, the tool including a stationary first tool element and a movable second tool element. A drive moves the second tool element with respect to the first tool element. A pivot bearing has a pivot axis, the pivot axis being arranged in a plane parallel to the pliers head plane. A positioning device includes at least one receiving element for receiving a work piece. The positioning device is pivotable, turnable, swingable or rotatable with respect to the tool about the pivot axis of the pivot bearing to be moved from an insertion position for the work piece to a working position for the work piece. The invention is based on the idea of a generally different arrangement of the pivot bearing with its pivot axis than it is known from the prior art. The pivot bearing with its pivot axis is not arranged perpendicularly to the pliers head plane, but instead in a plane parallel to the pliers head plane. A plane parallel to the pliers head plane is to be understood as to include a plane being identical to the pliers head plane and parallel planes spaced apart from the pliers head plane. Thus, the pivot movement into the pliers head plane ends perpendicularly to the pliers head plane. Consequently, the advantage is attained that the positioning device is applicable to a C-shaped open pliers head, as well as to an annularly closed pliers head. Additionally, the structure and the function of the drive of the pliers and the movement of the tool elements with respect to one another is irrelevant to the novel positioning device. Thus, an universal positioning device is provided, the positioning device being usable with a great variety of different pliers and being capable of being removed at a great variety of different pliers. Due to the substantially different pivot movement, the number and the arrangement of the nests at the tool in the pliers head is completely independent from the positioning device. It is possible to increase the number of nests if desired. The number of nests only has to be coordinated with the number of receiving elements being located at the positioning device, and they have to be aligned in the working position. Another advantage of the novel positioning device is an improved accessibility and a good handling in the insertion position. The positioning device allows for an easy and secure insertion even of very small workpieces in the corresponding receiving element. The receiving element may be designed as a deepening or as a protrusion being located at the positioning device. It is also possible to retrofit already existing pliers with the novel positioning device. Another advantage of the novel positioning device is that it does not impede a retooling of the pliers with other tools or sizes of tools. Additionally, it is also possible to remove the positioning device itself, as it is necessary in case of changing tools.

The positioning device should be pivotable in a pivot angle of at least 75 degrees, preferably of at least 90 degrees, between the insertion position and the working position. Dependent on the design and support of the positioning device, it is even possible to realize pivot angles up to approximately 180 degrees. Nevertheless, at pivot angles which are more than 90 degrees it is ensured that the pliers head itself does not hinder the insertion operation, i.e. it does not block the clearance being necessary for the insertion operation.

Generally, it is possible to arrange the pivot axis of the positioning device in each an every desired position, as long as it is arranged in a plane parallel to the pliers head plane. The pivot movement in the working position should preferably end in a way to orient the workpiece in the working position with respect to the tool in the pliers head. In case of an elongated design of the workpiece, as it is typical of connectors, the axis of the workpiece should be arranged in the working position perpendicularly to the pliers head plane. If the pivot axis of the pivot bearing of the positioning device is arranged in the plane parallel to the pliers head plane in the moving direction of the tool element, the pivot axis extends in the main direction of extension of the pliers in many different types of pliers. Thus, the positioning device is pivoted within a plane being oriented perpendicularly to the main direction of extension of the pliers. Consequently, the advantage occurs that the pliers, in case their drive is formed by two pivotable handles, can be held at the handles during the pivot movement. On the other hand, it is also possible to arrange the pivot axis of the pivot bearing of the positioning device in the plane parallel to the pliers head plane perpendicularly to the direction of movement of the tool element. In this embodiment, the positioning device is pivoted in the insertion position in a way to approach and to move away from the handles, respectively. A secure and easy handling is possible.

The positioning device may include a fixing plate for its connection to the pliers head and a pivot plate carrying the receiving element. The pivot bearing with its pivot axis is located between the fixing plate and the pivot plate. This arrangement is especially advantageous for a universal positioning device being connectable to different pliers in one common embodiment. On the other hand, it is also possible not to use a fixing plate, and to directly connect the pivot bearing with its pivot axis at the pliers, especially at the pliers head.

In all embodiments, it is possible to design the pivot bearing to be detachable for the removal of the pivot plate. Thus, it is possible to only remove one element of the positioning device, namely the pivot plate including the receiving element and the receiving elements, respectively. This is true for a removal of a pivot plate having a worn-out receiving element, as well as for a removal of a pivot plate and the assembly of a different pivot plate including receiving elements of different dimensions, as it may be desired for the processing of workpieces having different diameters.

In case of processing certain workpieces, especially in the production of crimping connections, it makes sense to flexibly support the positioning device or at least the pivot plate in the working position to allow for an elongation of the workpiece during processing. In this way, an undesired pressing of the workpiece is prevented, and a displacement of the material of the workpiece during a permanent deformation is taken into account. For example, such a flexible support may be realized by the positioning device and especially its pivot plate including a magnet flexibly securing the working position. But it is also possible to flexibly secure the working position by a spring biased locking ball, a leg spring or a similar flexible arrangement. A spring element may be provided, the spring element effecting the pivot movement in the working position when the user lets go the pivot plate after inserting the workpiece in the insertion position.

A stop may be arranged to limit the pivotability of the positioning device and especially of the pivot plate in the insertion position. The stop which may also be designed to be locking limits the pivot movement from the working position to the insertion position. At the same time, the stop forms an abutment during the insertion operation of the workpiece into the receiving element.

The invention may be applied to a great variety of different pliers. Preferably, the movable tool element of the pliers is linearly guided, or it is guided on a circuit. In all cases, the pivot axis of the pivot bearing has a structural design, for example it is designed as a hinge, a pin, a stud, or the like engaging a cylindrical opening or the like.

It is an object of the present invention to provide pliers including a positioning device for a workpiece being applicable to a C-shaped pliers head as well as to an annularly closed pliers head.

Another object of the present invention is to provide pliers including a positioning device for a workpiece in which the number and the arrangement of the nests of the tool being arranged inside the pliers head is not limited by the positioning device.

Another object of the present invention is to provide pliers in which the positioning device is flexible to enable an elongation of the workpiece when the workpiece is located in its working position in the pliers head.

Another object of the present invention is to provide pliers having an improved accessibility and an improved handling.

Another object of the present invention is to provide pliers facilitating the insertion of very small workpieces into the receiving element.

Another object of the present invention is to provide pliers not impeding a removal of the tools or other elements of the pliers.

Another object of the present invention is to provide pliers in which the positioning device can be easily removed.

Another object of the present invention is to provide a positioning device which can be retrofitted to existing pliers.

Still another of the present invention is to provide an universal positioning device being usable in pliers of many different kinds.

Other objects, features and advantages of the present invention will become apparent to one with skill in the art upon examination of the following drawings and the detailed description. It is intended that all such additional objects, features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
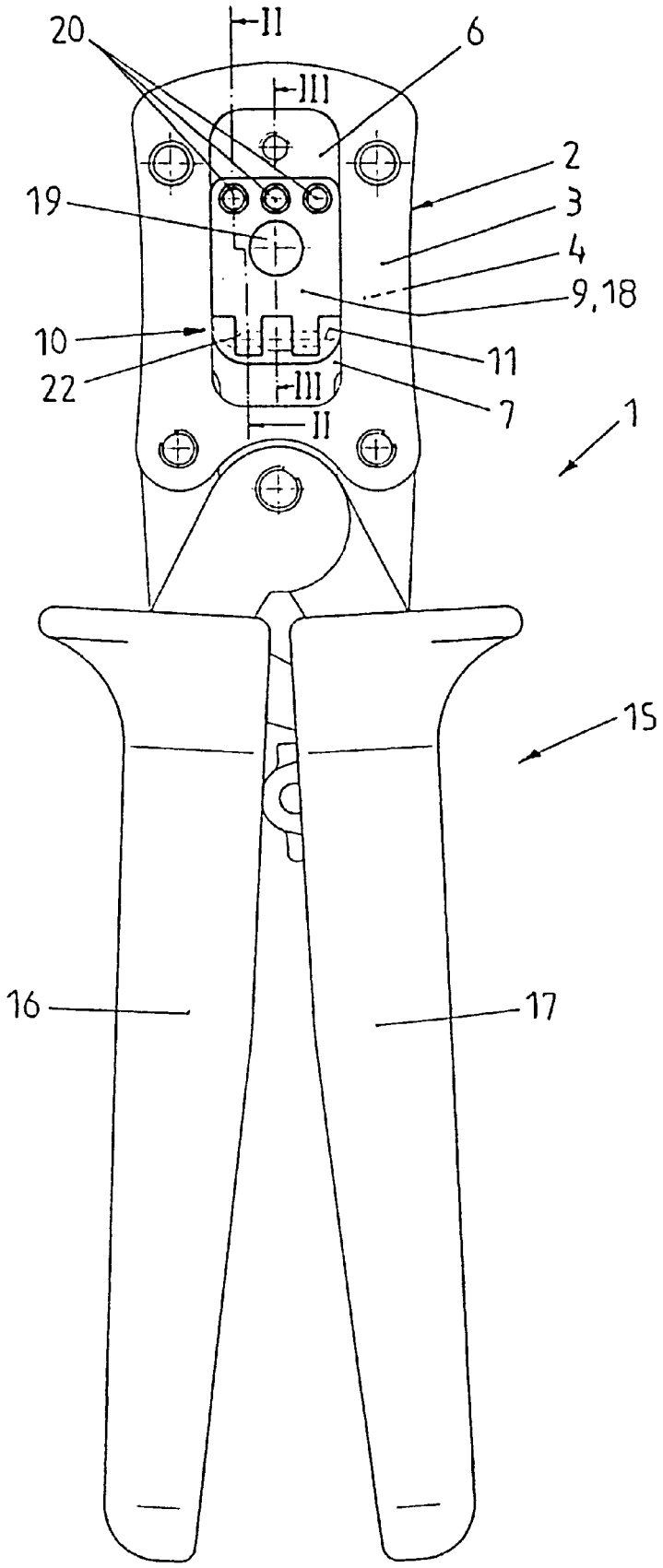
FIG. 1 illustrates a view of pliers having an annularly closed pliers head.
Figure 2:
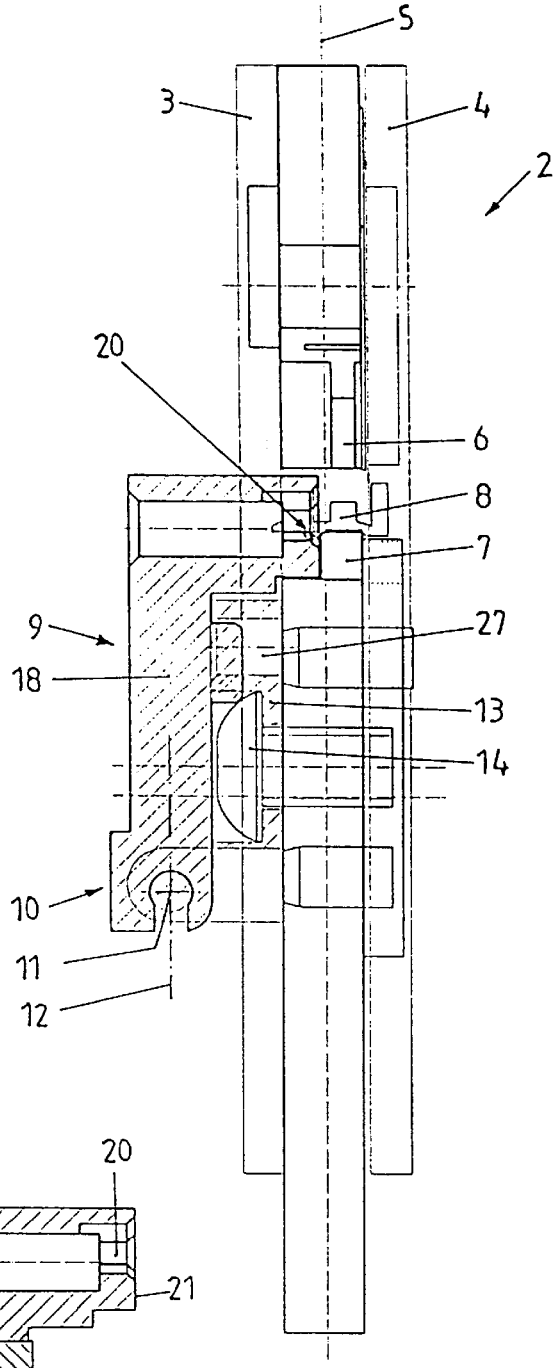
FIG. 2 illustrates a sectional view along line II—II in FIG. 1 through the pliers head including a positioning device.

Referring now in greater detail to the drawings, FIG. 1 illustrates a view of pliers 1 having an angularly closed pliers head 2 in a plate design, the pliers head 2 including two identical cover plates 3 and 4. Usually, the cover plates 3 and 4 are arranged symmetrically to a pliers head plane 5 (FIG. 2). The pliers head plane 5 is defined by the two main directions of extension of the pliers head 2. In FIG. 1, the pliers head plane 5 is identical to the plane of illustration. Two tool elements 6, 7 are arranged inside the pliers head 2, the tool elements 6 and 7 forming a tool. The tool element 6 is stationary with respect to the pliers head 2. The tool element 7 is movable with respect to the pliers head 2 and to the stationary tool element 6. The tool element 7 is linearly guided by the frame-like closed cover plates 3 and 4. The tool elements 6 and 7 may be corresponding pressing anvils with which it is possible to permanently deform a workpiece (FIG. 2) by a pressing operation, for example to produce a crimping connection. Therefore, the workpiece 8 has to be exactly positioned with respect to the tool elements 6 and 7. The workpiece 8 is positioned by a positioning device 9 being pivotally connected to the pliers head 2 by a pivot bearing 10 having a pivot axis 11. The pivot bearing 10 is designed and arranged to have its pivot axis 11 in a plane 12 being arranged parallel to the pliers head plane 5 (FIG. 2). Usually, the plane 12 is spaced apart from the pliers head plane 5. But it is also possible that the pliers head plane 5 and the plane 12 are identical.

The positioning device 9 includes a fixing plate 13 being connected to a portion of the pliers head 2 by a screw 14. The portion of the pliers head 2 is connected to the movable tool element 7 and to a drive 15. Two levers 16 and 17 may serve as drive 15 (FIG. 1). The levers 16 and 17 are pivotally arranged at the pliers head 2 with respect to one another in a known manner, and they drive or move the movable tool element 7 linearly in the direction of main extension of the pliers 1.

Further to the fixing plate 13, the positioning device 9 includes a pivot plate 18. The pivot plate 18 is pivotally connected to the fixing plate 13 by the pivot bearing 10, so that the pivot plate 18 can be pivoted about the pivot axis 11 (see FIGS. 5 and 6). The pivot plate 18 (FIG. 3) includes a protruding pin 19 at its side facing away from the pliers head plane 5. The pin 19 serves to facilitate the handling of the pivot plate 18 to conduct a pivot operation about the pivot axis 11. On its other side, i.e. the side facing the pliers head 2, the pivot plate 18 includes at least one receiving element 20. FIG. 1 illustrates three receiving elements 20 being arranged side by side at the positioning device 9 and at the pivot plate 18, respectively. The receiving elements 20 are allocated to three nests being arranged at the tool elements 6 and 7, and they may be designed for different diameters of workpieces 8. Each receiving element 20 is designed as a deepening in the rear surface 21 of the pivot plate 18. But it is also possible that the receiving element 20 is designed as a protrusion being arranged at the positioning device 9 and at the pivot plate 18, respectively. Especially, it may be designed as a protruding pin to put bush-like or tube-like workpieces 8 over the pin.

Figure 3:
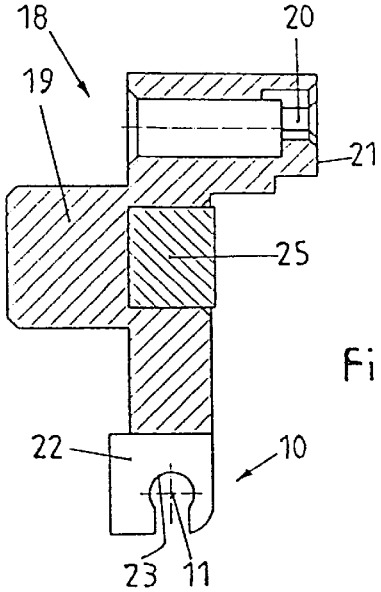
FIG. 3 illustrates a sectional view of a pivot plate of the positioning device along line III—III in FIG. 1.
Figure 4:
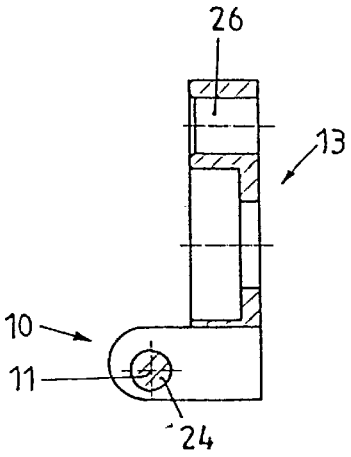
FIG. 4 illustrates a sectional view of a fixing plate of the positioning device.

FIG. 3 illustrates a sectional view of the pivot plate 18 of the positioning device 9. The pivot plate 18 may be especially designed of molded plastic. Preferably, the pivot plate 18 includes a plurality of projections 22 having circumferentially opened openings 23 in the lower region of the pivot plate 18 to realize the elements of the pivot bearing 10 which are arranged at the pivot plate 18. By means of the openings 23, the pivot plate 18 can be detachably put on a pin 24 being located and supported at the fixing plate 13 (FIG. 4). The pin 24 and the circumferentially opened opening 23 have an aligned pivot axis 11 in their mounted position. A magnet 25 is arranged in the lower region of the rear side 21 of the pivot plate 18, the magnet 25 in the working position (FIGS. 2 and 6) flexibly securing the working position. The flexibility, i.e. the capability of locking the pivot plate 18 in the working position, makes sense if an elongation of the workpiece 8 occurs during the operation. Thus, the pivot plate 18 may pivot upwardly to a small extend, and it allows the elongation of the workpiece 8 during the pressing operation without the workpiece 8 being pressed or handled in another undesired way. The magnet 25 acting between the pivot plate 18 and the fixing plate 13 may be also arranged at the fixing plate 13. Since the fixing plate 13 may be also designed of molded plastic, it preferably includes a bore 26 being engaged by a steel pin 27 (FIG. 2) in the mounted position, the steel pin 27 working together with the magnet 25. The steel pin 27 also serves to lock the fixing plate 13 together with the screw 14 at the pliers head 2, i.e. to prevent them from turning. Instead of a magnet 25, or additionally to a magnet 25, the pivot plate 18 may include one or more cylindrical projections 28 on its rear side 21, the projections 28 engaging and fixedly contacting, respectively, bores (not illustrated) being located in the fixing plate 13 in the working position. This arrangement may serve to eliminate undesired movement within the pivot bearing 10 in the working position, and to stabilize the working position of the positioning device 9 of the pivot plate 18, respectively, with the inserted workpiece 8. Such undesired movement may result from the arrangement of the pivot bearing 10 and/or from frequent use of the positioning device 9.

Figure 5:
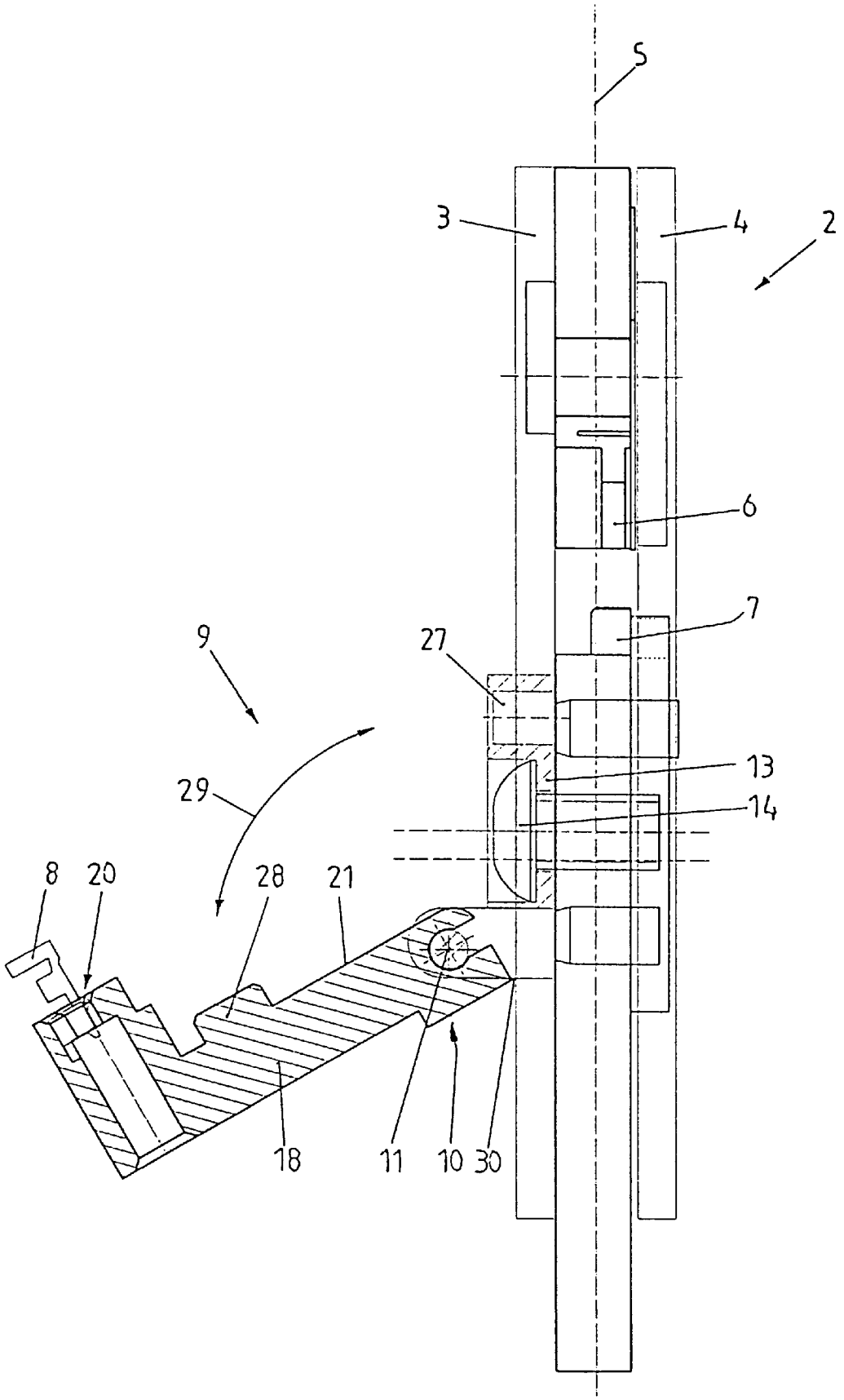
FIG. 5 is a similar illustration as FIG. 2 showing the pivot plate in its insertion position.
Figure 6:
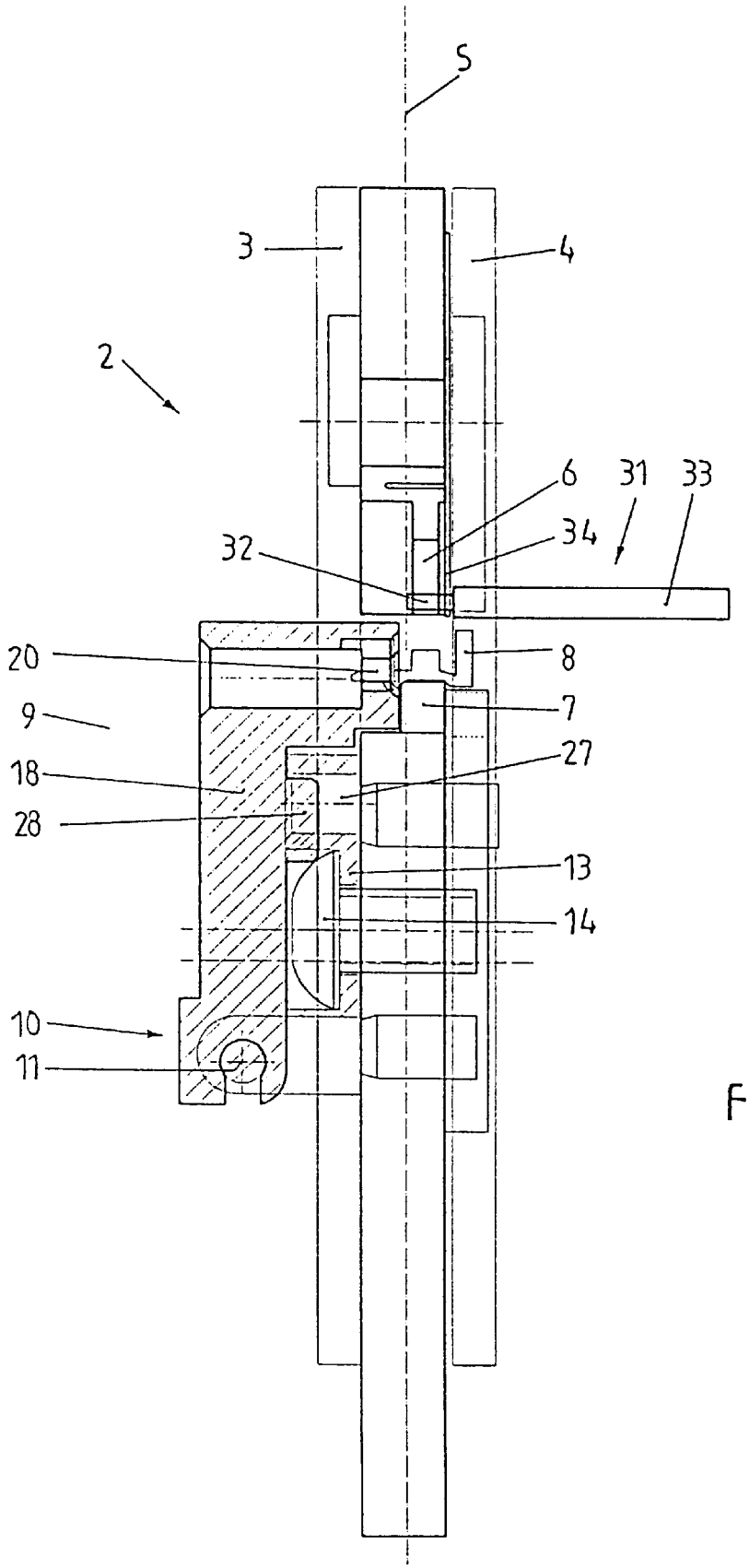
FIG. 6 illustrates a side view of the pliers head with the pivot plate in the working position and with an inserted conductor to be crimped.

As it can be seen from a comparison of FIGS. 5 and 6, the pivot plate 18 is pivotable from the insertion position (FIG. 5) in the working position (FIG. 6) about a pivot angle 29 about the pivot axis 11 of the pivot bearing 10. The pivot angle 29 should at least be 25 degrees. Preferably, the pivot angle 29 is more than 90 degrees, for example approximately 120 degrees, as illustrated in FIG. 5. The pivot angle 29 is limited by a stop 30 being formed by the cover plate 3. In the insertion position (FIG. 5), and edge of the pivot plate 18 contacts the stop 30. At the same time, the stop 30 forms an abutment for the pivot plate 18, so that the pivot plate 18 is fixed in the insertion position (FIG. 5), and the workpiece 8 can be exactly inserted into the chosen receiving element 20. The insertion or mounting of the workpiece 8 in the receiving element 20 is done manually, the workpiece 8 usually being held and guided between the thumb and the index finger of the user. FIG. 5 illustrates a connector as workpiece 8, as it is needed in case of a crimping connection with a partially bared electrical conductor. In this case, two crimping connections have to be produced, meaning a connection to the insolating material of the electrical conductor and a connection to the metal core of the electrical conductor.

FIG. 6 illustrates the relative position of the elements before a working operation and a crimping operation, respectively, is started. The pivot plate 18 of the positioning device 9 has been pivoted from the insertion position according to FIG. 5 about the pivot angle 29 in the working position according to FIG. 6. Thus, the workpiece 8 in form of a connector is exactly positioned with respect to the movable tool element 7. The axis of the workpiece 8 and the axis of the movable tool element 7 are aligned. It can be seen from FIGS. 5 and 6 that the workpiece 8 is perpendicularly positioned in the working position from one side into the pliers head 2 in the direction of the pliers head plane 5. An electrical conductor 31 with its bare metal core is inserted from the other side of the pliers head 2, i.e. with respect to the pliers head plane 5, until the face of its insolating material 33 contacts a positioning stop 34. The positioning stop 34 may be designed as a thin plate being movable against the force of a spring inside the pliers head 2, as this is known from the prior art. The positioning stop 34 serves to provide the desired position of the electrical conductor 31. The positioning stop 34 does not have any effect on the positioning of the workpiece 8 in the pliers head 2 in the working position. Of course, the positioning stop 34 is coordinated with the relative position of the workpiece 8 in the pliers head 2 in the working position. But it can be seen from FIG. 6 that the axis of the workpiece 8 and of the receiving element 20, respectively, and the axis of the electrical conductor 31 are spaced apart from one another. This is true in the opened position of the pliers 1. During the working operation, i.e. for example a crimping operation, the movable tool element 7 at which also the positioning device 9 with its pivot axis 18 is located is moved upwardly in a linear direction, i.e. in the direction of the stationary tool element 6. Consequently, the two illustrated cramps of the workpiece 8 being designed as a connector surround the metal core 32 and the insolating material 33. Both desired connections are produced by one common crimping operation. After finishing the working or crimping operation, the conductor 31 is connected to the workpiece 8, and it remains in its relative position with respect to the movable tool element 7 when the pliers 1 are opened, so that the unity formed by the conductor 31 and the workpiece 8 can be unloaded from the pliers 1 in a direction opposite to the insertion movement of the electrical conductor 31 with respect to the pliers head plane 5. After the pivot plate 18 of the positioning device 9 is pivoted in the insertion position according to FIG. 5, the next workpiece 8 may be inserted, and the working operation may be repeated.

Figure 7:
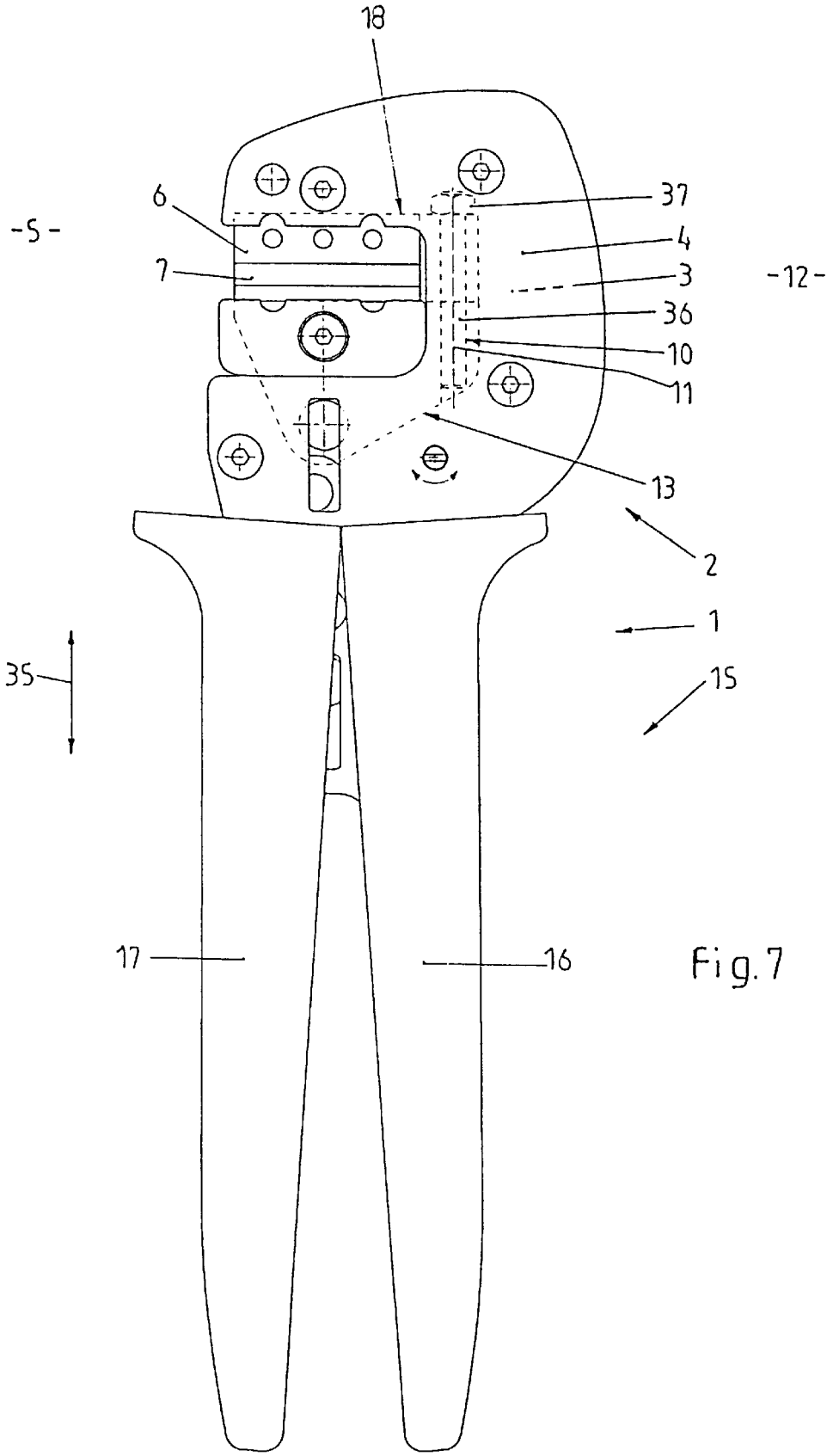
FIG. 7 illustrates a side view of pliers having a C-shaped pliers head and positioning device.
Figure 8:
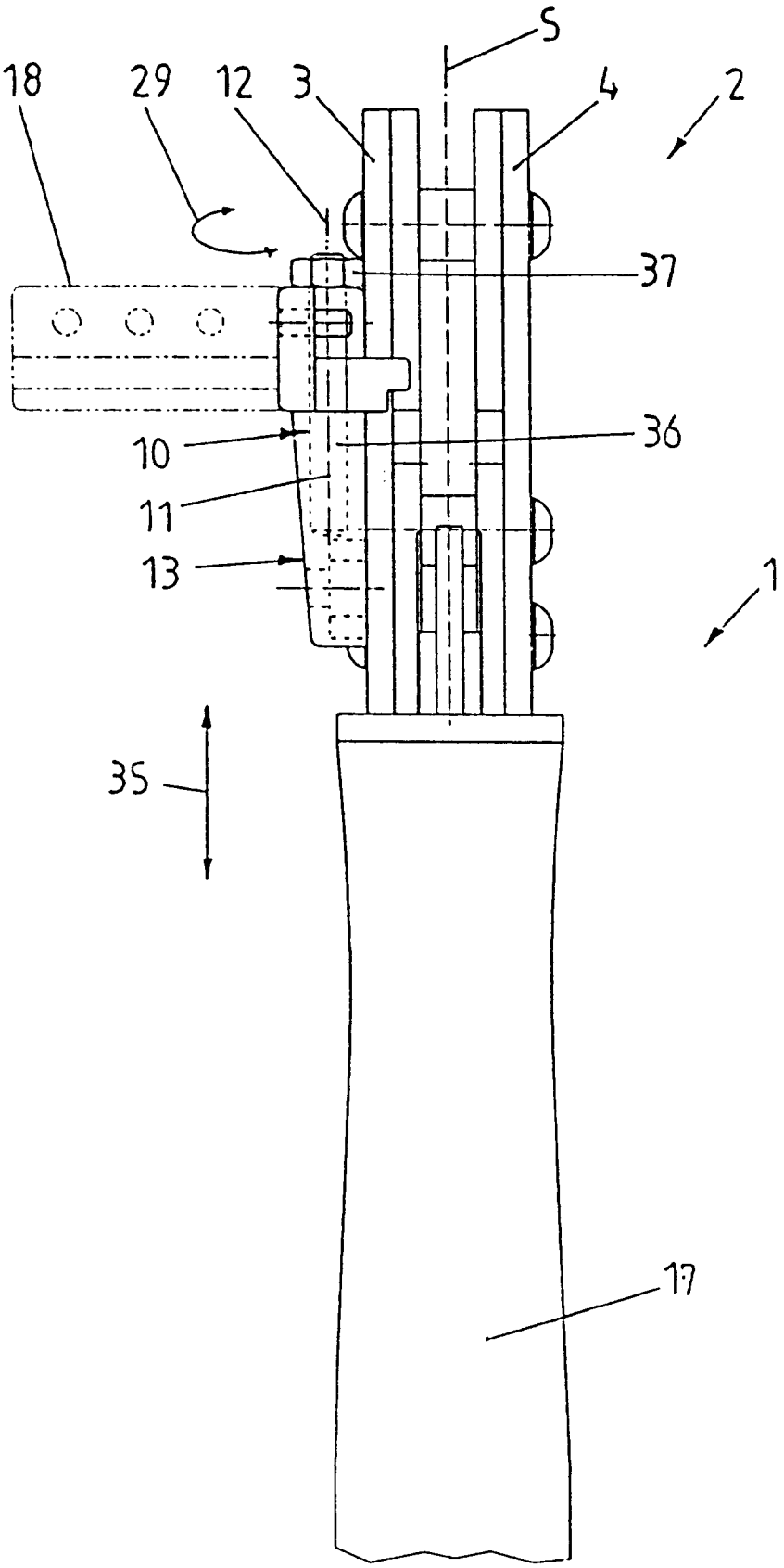
FIG. 8 illustrates a side view of the pliers according to FIG. 7.
Figure 9:
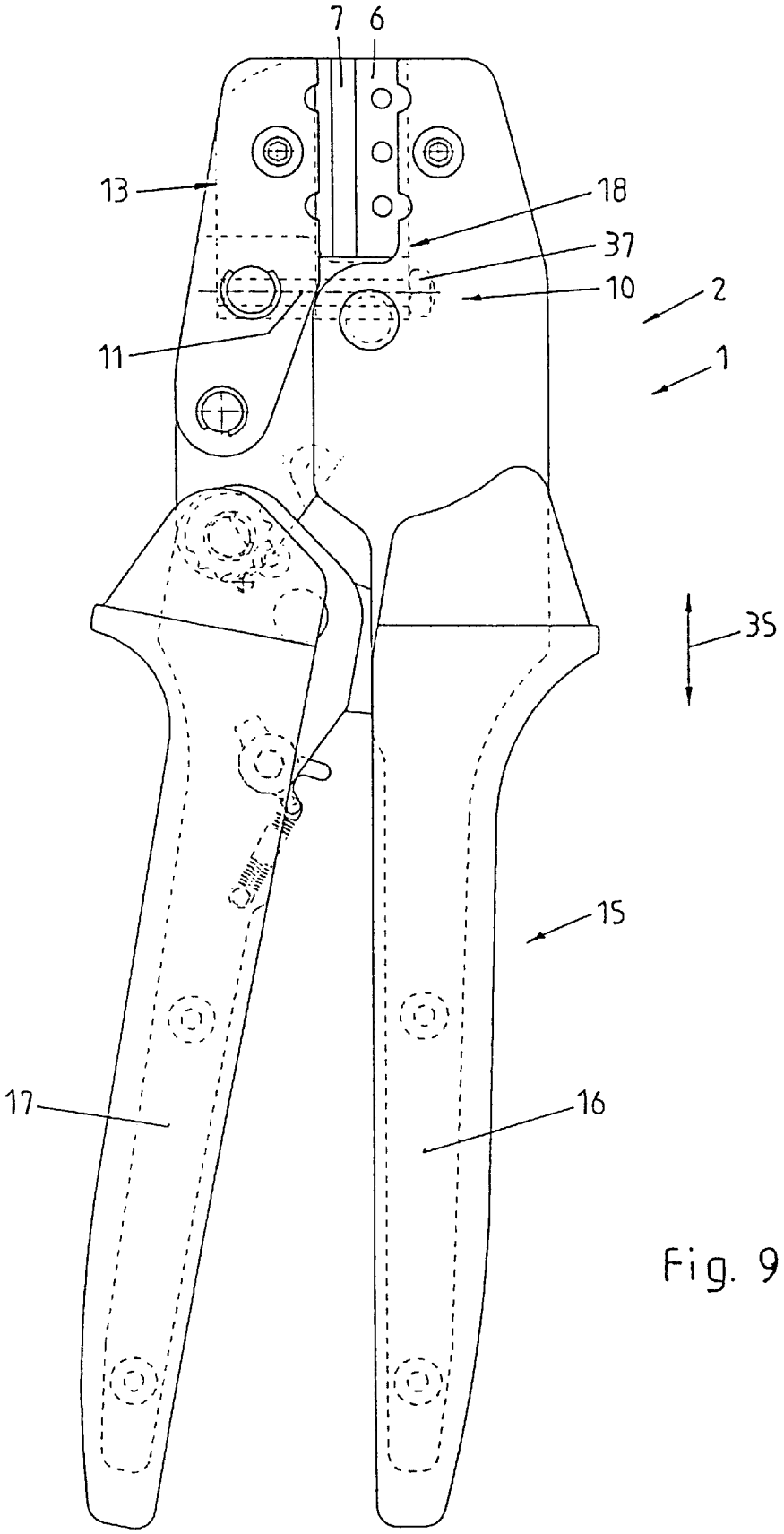
FIG. 9 illustrates a side view of pliers having a scissors-like movement of the tool.

FIGS. 7 and 8 illustrate a second embodiment of the pliers 1. The pliers head 2 has a C-shaped design. The cover plates 3 and 4 are not annularly closed, but they are designed to be opened from one side. The tool being arranged in the pliers head 2 also includes a stationary tool element 6 and a movable tool element 7 which is movable with respect to the stationary tool element 6. The fixing plate 13 of the positioning device 9 is illustrated by a dotted line in FIG. 7. The fixing plate 13 is movable together with the tool element 7. But it is also possible to arrange the fixing plate 13 at the pliers head 2 in a stationary manner. The chosen design and arrangement of the fixing plate 13 depends on the kind of the operation to be done to the workpiece 8. The positioning device 9 also includes a pivot plate 18 being illustrated in the insertion position by two points and a dot and in the working position by continuous lines (FIG. 8). The pivot angle 29 is illustrated by a double arrow. A pivot bearing 10 with its pivot axis 11 is arranged between the pivot plate 18 and the fixing plate 13. It can be seen from FIGS. 7 and 8 that the pivot axis 11 is arranged in the plane 12 in the direction of main extension 35 of the pliers 1, so that the pivot plate 18 can be pivoted in the insertion position laterally to the pliers head 2. In contrast to the embodiments of FIGS. 1 to 6, the pivot axis 11 of the pivot bearing 10 is arranged in the plane 12 transverse to the direction of main extension 35 of the pliers 1. It is clear that other positions of the pivot axis 11 of the pivot bearing 10 are also possible. The two described relative positions of the pivot axis 11 of the pivot bearing 10 are preferred embodiments.

As it can be seen from FIGS. 7 and 8, a pin 36 is part of the pivot bearing 10, the pin 36 being inserted into the fixing plate 13 and defining the pivot axis 11. The pin 36 includes a threaded shank being arranged at its portion protruding from the pivot plate 18. A nut can be screwed on the threaded shank of the pin 36. Thus, it is easily possible to keep the fixing plate 13 in its position at the pliers head 2, and to remove the pivot plate 18 just by loosening the pivot bearing 10 in case a positioning device 9 including receiving elements 20 of different dimensions are to be used. For example, this is necessary in case the tool elements 6 and 7 are to be removed.

Figure 10:
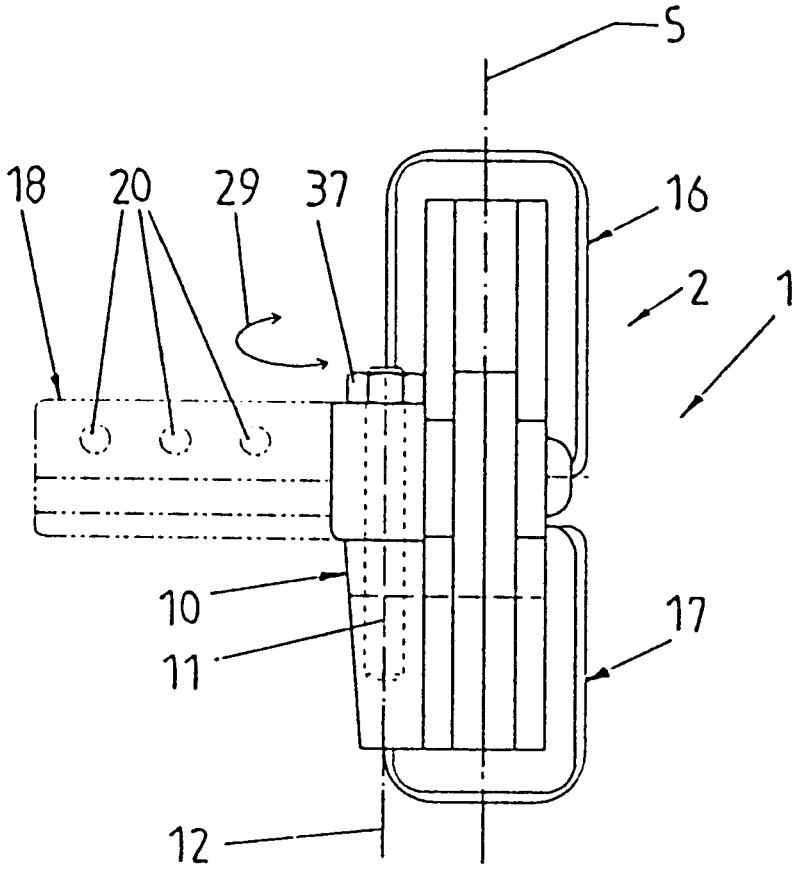
FIG. 10 illustrates a top view of the pliers according to FIG. 9.

Whereas the movable tool element 7 is linearly guided in the embodiments of the pliers 1 according to FIGS. 1 to 6 and 7 to 8, FIGS. 9 and 10 illustrate pliers 1 having a scissors-like movement, i.e. the movable tool element 7 is guided on a circuit. Pliers like that are generally known in the art. It can be seen from FIGS. 9 and 10 that a positioning device 9 being generally described with respect to the embodiment according to FIGS. 7 and 8 is used. The relative position of the pivot bearing 10 with the pivot axis 11 in the plane 12 with respect to the pliers head 2 is emphasized. FIG. 10 illustrates a top view of the pliers 1 in the direction of main extension 35. Thus, it is clear that the general structure of the pliers 1 does not depend on the structure of the positioning device. The positioning device 9 is a universal positioning device being applicable to the different illustrated kinds and structures of pliers 1.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers comprising:

a pliers head defining a pliers head plane and including a tool, the pliers head plane being defined by the two main directions of extension of said pliers head, said tool including a stationary first tool element and a movable second tool element;

a drive for moving said second tool element with respect to said first tool element;

a pivot bearing having a pivot axis, the pivot axis being arranged in a plane parallel to the pliers head plane; and a positioning device including at least one receiving element for receiving a work piece, said positioning device being pivotable with respect to said tool about the pivot axis of said pivot bearing to be moved within a plane being oriented perpendicularly to the pliers head plane from an insertion position for the work piece to a working position for the work piece.

2. The pliers of claim 1, wherein the plane of the pivot axis is spaced apart from the pliers head plane.

3. The pliers of claim 1, wherein the plane of the pivot axis identical to the pliers head plane.

4. The pliers of claim 1, wherein said positioning device is pivotable about the pivot axis in an angle of at least 75 degrees between the insertion position and the working position of the work piece.

5. The pliers of claim 1, wherein said positioning device is pivotable about the pivot axis in an angle of at least 90 degrees between the insertion position and the working position of the work piece.

6. The pliers of claim 1, wherein the pivot axis of said pivot bearing of said positioning device is arranged in the plane parallel to the pliers head plane and substantially in a moving direction of said second tool element.

7. The pliers of claim 1, wherein the pivot axis of said pivot bearing of said positioning device is arranged in the plane parallel to the pliers head plane and substantially perpendicular to a moving direction of said second tool element.

8. The pliers of claim 1, wherein said positioning device includes a fixing plate for its connection to said pliers head and a pivot plate carrying said receiving element, said pivot bearing with its pivot axis being arranged between said fixing plate and said pivot plate.

9. The pliers of claim 8, wherein said pivot bearing is designed and arranged to be detachable to remove said pivot plate.

10. The pliers of claim 1, wherein said positioning device is designed and arranged to be flexible to enable an elongation of the work piece when the work piece is located in its working position in said pliers head.

11. The pliers of claim 8, wherein said pivot plate of said positioning device is designed and arranged to be flexible to enable an elongation of the work piece when the work piece is located in its working position in said pliers head.

12. The pliers of claim 10, wherein said positioning device includes a magnet flexibly securing the working position of the work piece.

13. The pliers of claim 11, wherein said pivot plate includes a magnet flexibly securing the working position of the work piece.

14. The pliers of claim 1, further comprising a stop to limit the pivotability of said positioning device in the insertion position of the work piece.

15. The pliers of claim 8, further comprising a stop to limit the pivotability of said pivot plate of said positioning device in the insertion position of the work piece.

16. The pliers of claim 1, wherein said movable second tool element is designed and arranged to be movably guided linearly in said pliers head.

17. The pliers of claim 1, wherein said movable second tool element is designed and arranged to be movably guided circularly in said pliers head.

18. Pliers comprising:

a pliers head defining a pliers head plane and including a tool, the pliers head plane being defined by the two main directions of extension of said pliers head, said tool including a stationary first tool element and a movable second tool element;

a drive for moving said second tool element with respect to said first tool element;

a pivot bearing having a pivot axis, the pivot axis being arranged in a plane parallel to the pliers head plane; and a positioning device including a fixing plate for connecting said positioning device to said pliers head and a pivot plate carrying at least one receiving element for receiving a work piece, said pivot bearing with its pivot axis being arranged between said fixing plate and said pivot plate, said positioning device being pivotable with respect to said tool about the pivot axis of said pivot bearing to be moved within a plane being oriented perpendicularly to the pliers head plane from an insertion position for the work piece to a working position for the work piece.

19. The pliers of claim 18, wherein said pivot bearing is designed and arranged to be detachable to remove said pivot plate.

20. The pliers of claim 18, wherein said pivot plate of said positioning device is designed and arranged to be flexible to enable an elongation of the work piece when the work piece is located in its working position in said pliers head.

21. The pliers of claim 20, wherein said pivot plate includes a magnet flexibly securing the working position of the work piece.

22. Pliers comprising:

a pliers head defining a pliers head plane and including a tool means, the pliers head plane being defined by the two main directions of extension of said pliers head, said tool means including a stationary first tool element and a movable second tool element;

first means for moving said second tool element with respect to said first tool element;

second means for positioning and moving a work piece with respect to said pliers head from an insertion position to a working position;

third means for receiving the work piece, said third means being connected to said second means; and fourth means for pivotally supporting said second means, said fourth means having a pivot axis being arranged in a plane parallel to the pliers head plane to allow for a movement of said second means within a plane being oriented perpendicularly to the pliers head plane from the insertion position to the working position of the work piece.

23. The pliers of claim 22, wherein said second means include fixing means for their connection to said pliers head and pivot means carrying said third means, said fourth means with their pivot axis being arranged between said fixing means and said pivot means.

24. The pliers of claim 23, wherein said fourth means are designed and arranged to be detachable to remove said pivot means.

25. The pliers of claim 22, further comprising a stop means to limit the pivotability of said second means in the insertion position of the work piece.

26. The pliers of claim 23, further comprising a stop means to limit the pivotability of said pivot means of said second means in the insertion position of the work piece.

* * * * *